US005238805A

United States Patent [19]

Saitou

[11] Patent Number: 5,238,805

[45] Date of Patent: Aug. 24, 1993

[54] METHOD FOR PREPARING SILVER HALIDE EMULSION

[75] Inventor: Mitsuo Saitou, Kanagawa, Japan

[73] Assignee: Fuji Photo Film Co., Ltd., Kanagawa, Japan

[21] Appl. No.: 708,579

[22] Filed: May 31, 1991

[30] Foreign Application Priority Data

May 31, 1990 [JP] Japan ..... 2-142635

[51] Int. Cl.[5] ..... G03C 1/005

[52] U.S. Cl. ..... 430/569; 430/567

[58] Field of Search ..... 430/567, 568, 569

[56] References Cited

U.S. PATENT DOCUMENTS 4,301,241 11/1981 Saito ..... 430/569
4,798,775 1/1989 Yagi et al. ..... 430/569
4,879,208 11/1989 Urabe ..... 430/567
5,145,768 9/1992 Ichikawa et al. ..... 430/569
5,155,017 10/1992 Sato et al. ..... 430/569

FOREIGN PATENT DOCUMENTS 59-67534 4/1984 Japan ..... 430/569

*Primary Examiner*—Charles L. Bowers, Jr.
*Assistant Examiner*—Mark F. Huff
*Attorney, Agent, or Firm*—Sughrue, Mion, Zinn, Macpeak & Seas

[57] ABSTRACT

A method for preparing silver halide emulsion grains by a crystal growth method comprising feeding fine silver halide grains to a reaction vessel containing seed crystals of a silver halide emulsion and dissolving the fine grains in the reaction vessel by Ostwald ripening to grow said seed crystals, wherein the fine grains are non-twinned crystal fine grains having substantially no twinning plane.

19 Claims, 3 Drawing Sheets

METHOD FOR PREPARING SILVER HALIDE EMULSION

FIELD OF THE INVENTION

The present invention relates to a process for preparing silver halide (hereinafter referred to as AgX) emulsion grains which are useful in photography. More particularly, it relates to a process for preparing AgX emulsion grains, which scarcely forms new nuclei (namely, the growth rate of seed crystals being rapid), enables the degree of supersaturation during crystal growth to be more uniformly controlled and is freed from problems with regard to the preservability of fine grain emulsions.

BACKGROUND OF THE INVENTION

Many crystal growth methods wherein a previously prepared fine AgX emulsion grain is fed to a reaction vessel containing seed crystals of an AgX emulsion with stirring, and the fine grains are dissolved in the reaction vessel by Ostwald ripening to grow seed crystals have been proposed. For example, such methods are described in U.S. Pat. No. 4,242,445, JP-A-55-142329 (the term "JP-A" as used herein means an "unexamined published Japanese patent application"), JP-A-63-151618, JP-A-58-113926 to JP-A-58-113928, JP-A-57-23932, U.S. Pat. Nos. 2,146,938 and 3,317,322 and U.S. Pat. No. 4,879,208. In a system wherein an aqueous solution of a silver salt and an aqueous solution of a halide salt (hereinafter referred to as an $X^-$ salt) are added, a distribution of each their concentrations is present in the reaction solution until they are added and uniformly mixed. That is, the ununiformity of concentration of the silver salt and the halide salt occurs in the reaction solution. The distribution of the concentrations is continuously produced during the course of the addition thereof. It is believed that the reproducibility of the growth of AgX grains, the uniformity of the halogen composition, the uniformity of the formation of reduced silver nuclei, etc. are affected by the distribution of the concentrations. On the other hand, the above-described fine grain addition method has the advantage that fine grains are gradually dissolved to thereby supply solute ions so that the method is freed from the above-described disadvantages.

However, this method still has the following problems to be solved.

(1) There is the problem that the surface Gibbs free energy of the previously prepared fine grains is generally high and hence the fine grains are unstable and tend to be changed during storage. JP-A-57-23932 discloses a method wherein a fine grain emulsion prepared in the presence of a growth inhibitor is washed with water, dispersed and further re-dissolved and addition is then made. Since a growth inhibitor is present, the change in grain size during the storage of the emulsion is reduced, but there is the disadvantage that when the emulsion is added, the fine grains dissolve with difficultly.

(2) U.S. Pat. No. 4,879,208 discloses that in order to solve the above-described problem, a mixer is provided outside the reactor, an aqueous solution of a silver salt, an aqueous solution of an $X^-$ salt and an aqueous solution of a protective colloid are continuously fed to the mixer using a triple jet process and mixed to form fine AgX grains and the fine grain emulsion is continuously fed to the reaction vessel. In this method, the fine grains are fed to the reactor immediately after the formation thereof and the problem with regard to preservability does not occur. However, since an aqueous solution containing a silver salt at a high concentration and an aqueous solution containing an $X^-$ salt at a high concentration are directly mixed with each other, there is the disadvantage that degree of the supersaturation in the mixing zone becomes very high and the proportion (by number) of multiple twin grains in the fine grains becomes high (namely more than 2%). Further, the grain size distribution is broadened. When such fine grains are added, a problem occurs in that multiple twinned grains in the fine grains are grown and new nuclei tend to be formed.

(3) When the flow rate of the aqueous solution of the protective colloid is increased, or the aqueous solution of the silver salt or the aqueous solution of the $X^-$ salt is diluted to prevent the above-described problem from occurring, there is the disadvantage that the total amount of the solution to be added is greatly increased. Further, there is the disadvantage that because the method is a continuous process, there is the difficulty in increasing the amount of silver/ml. Accordingly, this method gives rise to problems in that the total amount of the solutions to be added is increased, the amount by mol of AgX prepared in a given reactor is reduced and production efficiency can not be increased.

(4) When the aqueous solution of the silver salt, the aqueous solution of the $X^-$ salt and the aqueous solution of the protective colloid are added according to the continuous method described in U.S. Pat. No. 4,879,208, they are not well-reacted in the mixer and there is the possibility that the soluble salts as such are added to the reactor. Moreover, there is the disadvantage that some fine grains stay in the mixer a long period of time and other fine grains stay only a short period of time. Thus, the residence time of the fine grains in the mixer is not uniform and hence, control can not be sufficiently made.

(5) With regard to the characteristics of fine grains to be added in the above-described fine grain addition method, fine grains having a grain size (i.e., diameter) of not larger than 0.1 μm are merely specified. Other characteristics (e.g., population of multiple-twinned grains) are not set forth at all. Moreover, there is no description that the supersaturation degree during the growth of the seed crystals is controlled depending on the grain size specified.

U.S. Pat. No. 4,242,445, JP-A-55-142329, JP-A-63-151618, JP-A-58-113926, JP-A-58-113927, JP-A-58-113928 and JP-A-57-23932 disclose the addition of a fine grain emulsion comprising fine grains having a grain size (i.e., diameter) of not larger than 0.1 μm, but do not disclose a method for preparing the fine grains and characteristics of the fine grains.

U.S. Pat. No. 2,146,938 discloses coarse grains formed by ripening the fine grain emulsion (i.e., by the Ostwald ripening between fine grains), which is different from the present invention. That is, the fine grain emulsion washed is disclosed in U.S. Pat. No. 2,144,938.

U.S. Pat. No. 3,317,322 discloses the formation of shell due to mixing a fine grain emulsion which is not subjected to chemical sensitization in a core emulsion which is subjected to chemical sensitization, but does not disclose a detail method for preparing the fine grain emulsion. That is, when according to Trivelli and Smith, *The Photographic Journal*, Vol. LXXIX, (May, 1939), P.P. 330–338, the proportion (by number) of multiple-twinned grains is measured, the value is 5% or more. Also, in U.S. Pat. No. 3,317,322, the prevention of mixing the multiple-twinned grains is not considered.

SUMMARY OF THE INVENTION

An object of the present invention is to provide a crystal growth method which is freed from the above-described problems caused by conventional crystal growth methods involving the addition of a fine grain emulsion and which enables individual factors to be much better controlled, enables uniform crystal growth to be achieved, provides crystal grains having high sensitivity and providing an image of good quality with good reproducibility.

The above-described objects of the present invention have been achieved by (1) a method for preparing silver halide emulsion grains by a crystal growth method comprising feeding silver halide grains to a reaction vessel containing seed crystals of a silver halide emulsion and dissolving the fine grains in the reaction vessel by Ostwald ripening to grow seed crystals, wherein the fine grains fed are non-twinned fine grains having substantially no twinning plane.

Further, the embodiments which are preferred in the present invention are shown below.

(2) a method for preparing silver halide emulsion grains as described in (1) above, wherein the method comprises forming the fine grains by providing a batch type mixer outside the reaction vessel, introducing an aqueous solution of a dispersion medium into the mixer and adding an aqueous solution of a silver salt and an aqueous solution of a halide salt thereto while stirring, and then immediately feeding the fine grains after formation to the reaction vessel from the mixer;

(3) a method for preparing silver halide emulsion grains as described in (1) above or (2) above, wherein the method comprises forming the fine grains by adding at least one of the aqueous solution of a silver salt and the aqueous solution of a halide salt to the batch type mixer through a porous material which is present in the aqueous solution of the dispersion medium;

(4) a method for preparing silver halide emulsion grains as described in (1), (2) or (3) above, wherein the method comprises forming the fine grains by separately diluting the aqueous solution of a silver salt and the aqueous solution of a halide salt with a bulking solution and then mixing them;

(5) a method for preparing a silver halide emulsion grains as described in (1), (2), (3) or (4) above, wherein the method comprises forming the fine grains in the presence of a dispersion medium of a low-molecular gelatin at a temperature of 0° to 45° C.;

(6) a method for preparing a silver halide emulsion grains as described in (1), (2), (3), (4) or (5) above, wherein the method comprises forming the fine grains by adding the aqueous solution of a silver salt and the aqueous solution of a halide salt by means of an accelerating addition method which involves the formation of new nuclei; and (7) a method for preparing silver halide emulsion grains as described in (1), (2), (3), (4) (5) or (6) above, wherein the method comprises adding the fine grains to the reaction vessel by using a plurality of pumps in an alternating manner.

BRIEF DESCRIPTION OF THE DRAWINGS

In FIG. 1, 2 and 3, the reference numbers represent the following:

1: mixer, 2: reaction vessel, 3,3': plunger, 4,4': cylinder, 5,5' 6,6' 9,9', 13: on-off valve, 7,7', 8,8', 12: opening, 10,23: bulking solution, 11,11': sealed packing, 15: driving member for driving plunger, 16: agitating blade, 17: system control device, 18,18': screwed shaft, 19,21: mixing box, 20,22: porous addition port, 24: addition system for an aqueous solution of a silver salt, 25: addition system for an aqueous solution of a halide salt, 26: gas pressure control device, 27,31: on-off valve, 28: orifice for controlling flow rate, 29: waste value, 30: baffle plate, 32: vacuum distillation device (low-temperature trap and pressure-reducing device).

Figure 4:
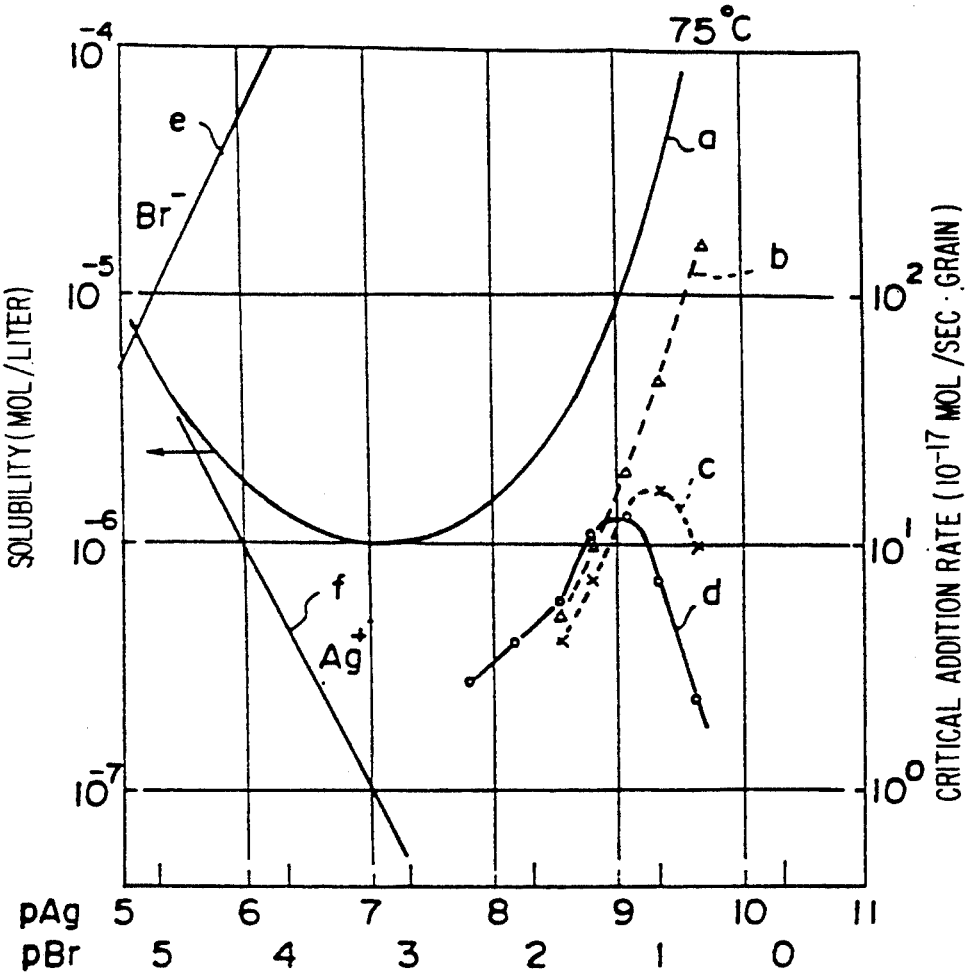

FIG. 4 shows a relation between a critical addition rate and the solubility, against the change in pAg and pBr values which are obtained in Example 2.

"a" represents a solubility curve of AgBr at 75° C.

"b", "c" and "d" each represents the critical addition speed when Fine grain **2*a* is added, when Fine grain 2*b*** is added, and when the solution is added, respectively.

"e" represents $Br^-$ concentration.

"f" represents $Ag^+$ concentration.

DETAILED DESCRIPTION OF THE INVENTION

The present invention is illustrated in more detail below.

(I) Preparation of Fine Grain Emulsion

It is preferred that the fine grains have substantially no multiple twinning plane in the present invention. This is because fine grains having a twinning plane are difficultly soluble and hence new nuclei tend to be formed. According to studies made by the present inventors, when the grain sizes are nearly the same, the solubility of the fine grains is such that multiple twinned grains (i.e., grains having two or more twinning planes per grain) have the following relationship: multiple twinned grains single twinned gains $\ll$ non-twinned grains. Accordingly, fine grains containing substantially no multiple twinned grains are preferable. The term "having substantially no multiple twinning plane" as used herein means that the proportion (by number) of grains having multiple twinning plane is generally not more than 1%, preferably not more than 0.3%, more preferably not more than 0.1% and most preferably not more than 0.01% and the best is 0%. The term "multiple" as used herein refers to two or more twinning planes. Details of the structure of the multiple twin grains are described in H. Frieser et al., *Foundation of Photographic Course of Silver Halide*, Chapter 3, Akademische Verlagsgesellchaft, Frankfurt am Main (1968).

Further, it is preferred that the single twinned grains is not substantially contained. The proportion (by number) of the single twinned grains is preferably 5% or less, more preferably 1% or less, most preferably 0.1% or less.

The proportion (by number) of the twinned grains is measured by observing a photographic image due to a transmission type electron microscope (TEM image) of a replica of grains in which the fine grain emulsion is grown so that the distinct grain form is obtained, under the condition of the high supersaturation without a new nuclear growth and at 40° C. or less and preferably 35° C. or less. The detail is described in JP-A-2-146033.

Also, it is more preferred that the grain size distribution of the fine grains is narrow. That is, the variation coefficient (y) of grain size distribution is preferably ($y<-80x+45$), more preferably ($y<-80x+38$) and most preferably ($y<-80x+30$), wherein y represents (Standard Deviation of Grain Size Distribution)/(Average Grain Size)×100%; X represents Average Grain Size. The grain size (i.e., diameter) is preferably 0.2 μm or less and more preferably 0.1 μm or less.

The halide composition of the fine grains is AgCl, AgBr, AgI and a mixed crystal comprising 2 or more silver halides thereof, and preferably Agcl, AgBr, AgBrI ($I^-$ content: 0 to 45 mol %) and a mixed crystal comprising 2 or more silver halides thereof.

Further, it is preferred that the fine grains are grains which have not been washed.

Also, it is preferred that the fine grains are formed in a mixing vessel equipped in the vicinity of a reaction vessel and immediately after the formation, are added to the reaction vessel. Further, the mixing vessel is preferably a batch type mixing vessel. Also, it is preferred that the fine grains are formed without use of a growth stopping agent.

It is preferred that fine grains which contain substantially no multiple twinned grains and have a grain size (i.e., diameter) of not larger than 0.2 μm are formed in the present invention.

Generally, to form fine grains, an aqueous solution of a silver salt and an aqueous solution of an $X^{-1}$ salt may be added in a short time (e.g., about 10 minutes or less) under conditions such that the solubility of AgX is as low as is possible (e.g., the concentration of the excess of $Ag^+$ or $X^-$ is lowered) (since no solvent for AgX is used, the temperature is as low as is possible (e.g., about 40° C. or less) and the pAg region in the lowest solubility on the solubility curve of AgX is chosen) and stirring is conducted with as high an efficiency as is possible. However, when the aqueous solution of a silver salt and the aqueous solution of an $X^{-1}$ salt are added in a short time under such low-temperature conditions, there is a tendency to increase the probability of the formation of the above-described multiple twinned grains. These conditions must be used to form fine AgX grains. Therefore, supersaturation factors during nucleation are controlled so that no twinning plane is formed. More specifically, it is preferred that at least one of the following techniques is used to suffice above provisions for the produced grains.

(1) The Concentration of Gelatin is Increased

The probability of the formation of twinning plane is reduced with an increase in the concentration of gelatin in the reaction solution. However, when conventional photographic gelatin is used at a too high a concentration, the viscosity of the reaction solution is increased at low temperatures in particular, the solution tends to gel and stirring mixing efficiency is lowered. Accordingly, the concentration of gelatin is preferably 1 to 10% by weight, more preferably 3 to 8% by weight, based on the reaction solution comprising water, gelatin, halogen, etc.

(2) Low-Molecular Weight Gelatin is Used

When the molecular weight of gelatin to be used is changed in the solution containing gelatin at the same concentration (wt %), the probability of the formation of twinning plane is most reduced in the molecular weight range of 10,000 to 30,000. Accordingly, it is desirable that gelatin having a molecular weight of preferably 5,000 to 60,000, more preferably 10,000 to 30,000 is used. Further, low-molecular weight gelatin is preferred, because the viscosity of the solution containing the same is not increased even at low temperatures and the solution does not tend to gel. For example, a 10 wt % solution of gelatin having a molecular weight of 10,000 does not gel even at 0° C. Even when the concentration of such a low-molecular weight gelatin is increased at a low temperature, the solution does not gel and the probability of the formation of twinning planes is low. Accordingly, low-molecular weight gelatins is particularly preferred. The concentration of gelatin is preferably 1 to 15% by weight, more preferably 3 to 12% by weight. When the average molecular weight of the gelatin is not more than 10,000 in particular, there is the possibility that when stirring is stopped, fine AgX grains slowly settle, since the viscosity of the fine grain emulsion is too low. To prevent the fine grains from settling, a solution of conventional photographic gelatin having a molecular weight of about 100,000 can be added after the formation of the fine grains. The amount of gelatin to be added can be controlled to such a range that the amount is less than that which does not cause the fine grains to gel and does not allow the settling rate to be too rapid. The amount of the low-molecular weight gelatin is preferably not less than 30% by weight, more preferably 70% by weight, based on the weight of the other dispersion medium present during the formation of the fine grains.

(3) Gelatin is Added to At Least One of the Aqueous Solution of a Silver Salt and the Aqueous Solution of an $X^-$ Salt Because the concentration of gelatin in the vicinity of a port through which the solutions are added is generally reduced, the probability of the formation of twinning plane is increased. It is not preferred for the concentration of the gelatin in the vicinity of the addition port to be reduced, because the supersaturation degree in the vicinity of the addition port in particular becomes high. More preferably, gelatin is added to both the aqueous solution of a silver salt and the aqueous solution of an $X^-$ salt. In this case, an acid (for obtaining a pH of 5 or less in the mixing solution) such as $HNO_3$ can be added to prevent the silver salt solution from being colored as white color by the formation of silver hydroxide or silver oxide. When gelatin having an average molecular weight of about 100,000 used in the field of photography is employed, the concentration of gelatin is preferably not more than 1.6%, more preferably 0.2 to 1.6% by weight from the viewpoint of preventing the aqueous solution thereof from gelling, while even low-molecular weight gelatin having an average molecular weight of 1,000 to 60,000 is used, gelatin can be used preferably at a concentration of not more than 10%, more preferably 0.2 to 10% by weight, because the aqueous solution thereof does not gel.

(4) Fine Grains are Formed in the Vicinity of the Isoionic Point of the $Ag^+$ and $X^-$ Concentration When the concentration of the excess of $Br^-$, $I^-$ or $Cl^-$ in the solution during the formation of the fine grains is lowered, the probability of the formation of twinning plane is reduced. When nucleation is carried out in the presence of an excess of $X^-$ ion, the degree of the contribution thereof to the formation of twinning planes is in order of $I^- > Br^- > Cl^+$ when compared at the same molar concentration. Accordingly, it is important to reduce the concentration of the excess of $I^-$ or $Br^-$ in particular. On the other hand, when nucleation is carried out in the presence of an excess of $Ag^+$, the probability of the formation of twinning planes is reduced with a lowering in the concentration of $Ag^+$. Namely, the probability of the formation of twinning planes is reduced as the excess amount of $Ag^+$ or $X^-$ is reduced.

The concentrations of excess $X^-$ or excess $Ag^+$ during the formation of the fine grains each is generally 0 to $10^{-2.1}$M, preferably 0 to $10^{-2.5}$M, per liter of the reaction solution.

This condition corresponds to the above-described low-solubility region on the solubility curve of AgX and to a preferred region as the condition for the formation of fine grains.

(5) The Value of pH is Lowered

When gelatin is used as a dispersion medium, the probability of the formation of a twinning plane is reduced with a lowering in the pH of the reaction solution. The dependence on pH is such that the AgCl system is greater than the AgBr system. The preferred pH region is not higher than 5, more preferably 4 to 1.8. With the proviso that it is possible that the probability of the formation also becomes reverse to the above relation, and therefore the practical pH is preferably determined by the experimentation, case by case.

(6) The Concentrations of Unrelated Salts are Increased

The probability of the formation of twinning planes is reduced with an increase in the concentration of unrelated salts such as $KNO_3$ and $NaNO_3$ in the solution. The concentration of the unrelated salt is preferably from 0 to 1 mol per liter of the solution.

(7) The $I^-$ Content in the $X^-$ Salt Solution Added During the Course of Nucleation is Lowered The probability of the formation of twinning planes is increased with an increase in the $I^-$ content in the $X^-$ salt solution added during the course of nucleation in the formation of the fine grains. Accordingly, it is preferable that the $I^-$ content is low in the allowable range thereof.

If the problems occur, the following methods can be used in combination. Methods for reducing the $I^-$ content include (a) a method wherein $I^-$ is supplied by adding fine AgI grains separately prepared, (b) a method wherein the $I^-$ content during nucleation (at least 10 seconds interval from the start) is adjusted to not higher than 7 mol %, and after completion of nucleation, the $I^-$ content is increased to the required value more than 7.5 mol % and (c) a method using a combination thereof.

(8) Silver Salt and $X^-$ Salt are Added by an Accelerating Addition System

Generally, an aqueous solution of a silver salt and an aqueous solution of an $X^-$ salt are often added at an equal rate in a short time by the double jet process. However, the supersaturation degree is the highest at the early stage of the addition and a twinning plane tends to be formed. Hence, the addition rate at the early stage of the addition at least 10 seconds interval from the start is lowered to 1/n (wherein n is from 1.2 to 30). When the rate is lowered, the probability of the formation of a twinning plane is reduced, but the number of nuclei formed is decreased. This results in the increase of the grain size of grains finally obtained when silver is added in the same amount. Accordingly, the solutions are subsequently added at an addition rate, which is m times (wherein m is from 1.2 to 30) (addition rate which causes the formation of new nuclei) that at the early stage of the addition, to increase the number of nuclei. The values of n and m and the number of the addition steps (preferably about 1 to 30 stage) are so chosen that the number of nuclei formed when the addition of the aqueous solution of the silver salt in the same amount by mol is completed is larger than that of conventional method. This method is the accelerating addition system. The growth of nuclei initially formed can be inhibited as much as possible by choosing low-temperature and low-solubility conditions.

The relationship between these nucleation conditions and the frequency of the formation of twinning plane is described in JP-A-63-92942, JP-A-2-838 and JP-A-2-146033.

The mixer for preparing the non-twinned fine grains is illustrated below.

Conventional AgX emulsion production devices can be used as mixers for use in forming the AgX fine grains. However, devices capable of rapidly and uniformly mixing the aqueous solution of a silver salt and the aqueous solution of an $X^-$ salt are particularly preferred. Since fine grains are formed by adding large amounts of the aqueous silver salt solution and the aqueous $X^-$ salt solution in a short time, supersaturation degree during the formation of fine grains become very high and grains having a defect such as a twinning plane are formed at a high frequency. Hence, those devices capable of rapidly and uniformly mixing these solutions are particularly preferred. Such devices are described in JP-A-2-146033.

Examples of suitable devices capable of rapidly and uniformly mixing these solutions include the following systems.

(1) A system wherein the addition ports of the feed pipes for the aqueous silver salt solution and the aqueous $X^-$ salt solution are provided in the vicinity of the agitating blade in the solution in the vessel and the solutions are vigorously stirred and mixed immediately when added.

Because the stirred state in the vicinity of the surface of the solution in the vessel is generally inferior to the other parts and when the agitating blade is provided in the vicinity of the surface of the solution in the vessel to stir rapidly the solutions added, foaming is violently formed and the stirring efficiency is adversely affected. The details of reaction devices in systems for direct addition to the subsurface of the solution are described in JP-B-55-10545 (the term "JP-B" as used herein means an "examined Japanese patent publication"), JP-B-58-

58288, JP-B-58-58289, JP-A-61-113056, JP-A-62-106451 and JP-Y-60-117834 (the term "JP-Y" as used herein means an "examined Japanese utility model publication").

(2) In the system (1), the aqueous silver salt solution and the aqueous $X^-$ salt solution are mixed in a small box (called mixing box) in the reaction vessel and discharged into a bulking solution such as a reaction solution being outside the box. In this case, the supersaturation of the silver salt and the supersaturation of the $X^-$ salt exist in the mixing box, and local supersaturation due to the concentration product becomes very high. This phenomenon is remarkable particularly when fine AgX grains are formed. To prevent this localized supersaturation from occurring, the aqueous silver salt solution and the aqueous $X^-$ salt solution are separately mixed and diluted in the mixing boxes and then discharged into the aqueous bulking solution. In this case, type (a) wherein both the diluted solutions are discharged into the bulking solution while they are mixed (examples thereof include the devices described in U.S. Pat. Nos. 3,415,650 and 3,785,777) and type (b) wherein both the diluted solutions are independently discharged into the bulking solution (an example thereof includes the device shown in FIG. 3 described hereinafter) can be used. When the rotating directions of both agitating blades are opposite to each other, it is preferred that the agitating blades provide a different agitating force. This is because overall agitation is reduced.) In type (b), the diluted solutions are diluted with the bulking solution and then are mixed with each other and hence localized supersaturation in the reaction vessel can be reduced to a very low level. Accordingly, type (b) is preferable to type (a).

(3) A system wherein the aqueous silver salt solution and the aqueous $X^-$ salt solution are added through a porous material.

The details of the term "porous material" are described in Japanese Patent Application Nos. 1-76678 and 2-326222 (i.e., U.S. patent application Ser. No. 628,127 filed on Dec. 17, 1990, abandoned) but the porous material is briefly illustrated below.

The porous material can be classified into the following two forms.

I. A membrane-form porous membrane generally called a filter with a pore size (i.e., diameter) of superfiltration (not larger than 10 Å), ultrafiltration (10 to $10^4$ Å), microfiltration (200 to $10^5$ Å) and filtration (pore diameter $> 10^4$ Å).

II. A hollow slender small tube which has only one outlet per tube. A tube having two or more outlets per tube is referred to as a class I tube.

The porous material is characterized by that the porous material has generally at least 4, preferably at least 10, more preferably 100 to $10^{15}$ addition ports for each solution to be added and the porous material has pores with a pore diameter of preferably not larger than 2 mm, more preferably 0.5 mm to 10 Å, still more preferably 0.1 mm to 20 Å, most preferably $10^4$ Å to 100 Å.

Figure 1:
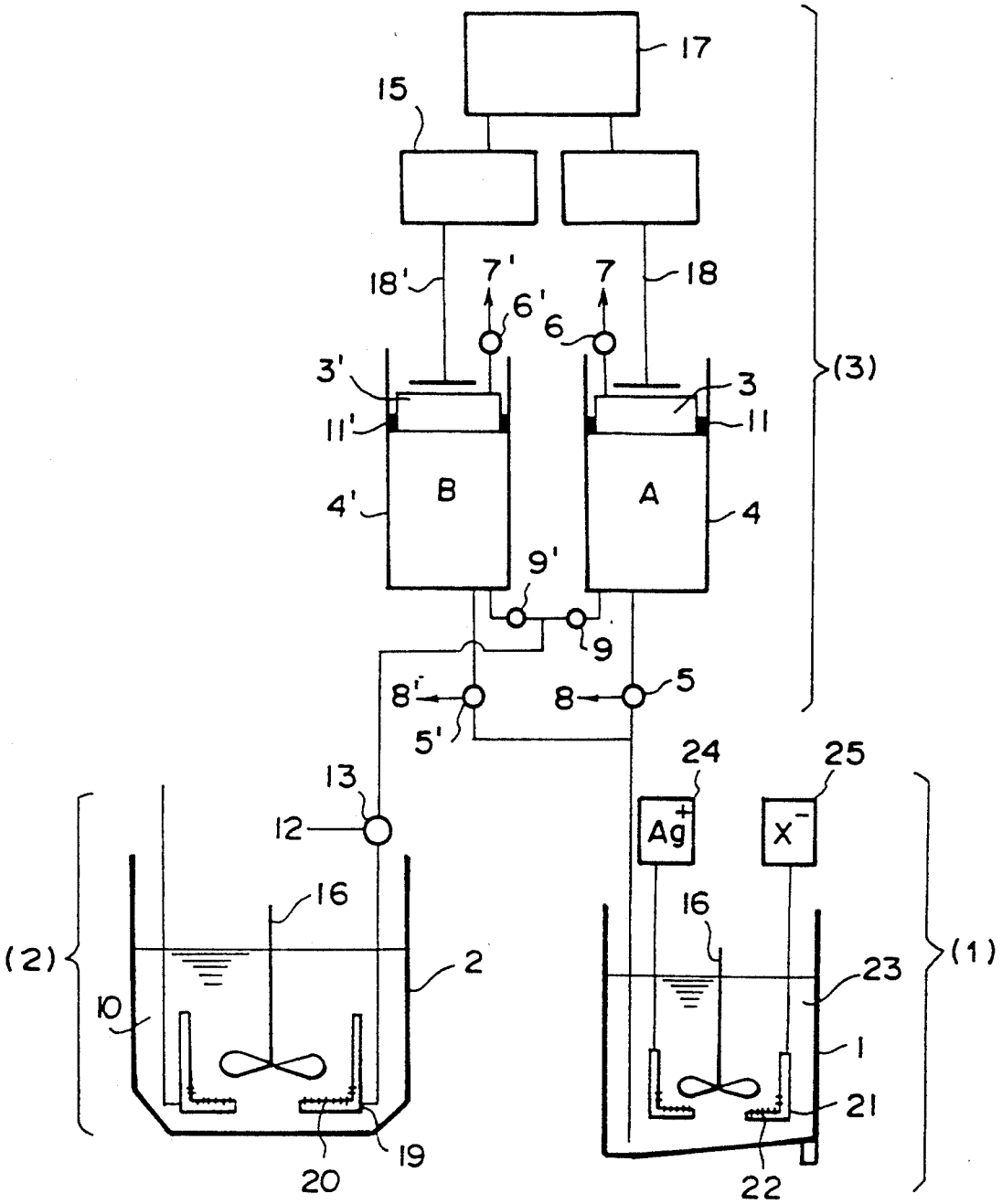
FIG. 1 shows schematically a preferred embodiment of a production unit for use in the preparation of a AgX emulsion according to the present invention wherein (1) represents a batch type mixer for the formation of fine AgX grains; (2) represents a reactor for growing seed crystals; and (3) represents an addition system for a fine grain emulsion.

Since the liquid droplet size of the solute solution to be added is reduced in this case, the specific surface area of the liquid droplet becomes large and the dilution effect is enhanced by molecular diffusion. The dilution effect by molecular $\sqrt{DT}$ is larger the smaller is the pore size of the addition port is, wherein D represents the diffusion coefficient of the solute ion and t is the time which has elapsed after addition. For example, an aqueous silver salt solution added through a pore having a pore size (diameter) of $10^2$ Å is diluted by about $10^{-4}$ times at room temperature for $10^{-4}$ seconds. Examples of this system include (a) a system wherein the addition ports for the aqueous silver salt solution and the aqueous $X^-$ salt solution are provided in one mixing box as shown in FIG. 1; (b) a system wherein the aqueous silver salt solution and the aqueous $X^-$ salt solution are separately added to the mixing boxes as described in the above (2); and (c) a system wherein the addition ports are uniformly scattered in the bulking solution (an example thereof includes the device shown in FIG. 1 of Japanese Patent Application No. 1-76678).

A device in which localized supersaturation is not formed is preferred as the mixer. From this point of view, the preferred order of the above systems is (3)>(2)>(1). In the case of system (3), uniform mixing can be achieved throughout the reaction vessel immediately after addition when the pore size is small and the pores are uniformly distributed throughout the reaction vessel. In the case of system (1) or (2), as the production scale becomes larger, the circulating flow rate must be increased to maintain the circulating frequency of the reaction solution constant. However, the flow rate is limited by foaming, etc. Further, as the production scale increases, the rate at which uniformity is achieved becomes slower. However, system (2) is preferable from the viewpoint of easy handling of the device.

(4) As an other device, there is a continuous mixer described in JP-A-1-183417. The probability of the formation of multiple twinned grains can be reduced by adding the aqueous silver salt solution and the aqueous $X^-$ salt solution through the porous material in combination with one or more of the above-described techniques (1) to (7). However, the system of (1) to (3) are more preferable than this system.

Accordingly, it is preferred that the fine grains are prepared by a batch system rather than a continuous method. Because the fine grains which are obtained by a batch system can optionally choose a required grain size and have a narrow distribution of grain size.

The temperature at which fine grains are formed is preferable 0° to 45° C., more preferably 5° to 35° C., most preferably 10° to 30° C. Low temperature is preferred because the grain size of fine grains is finer the lower the temperature and the coalescence of fine grains can be inhibited. The addition time is preferably 5 seconds to 15 minutes, more preferably 10 seconds to 5 minutes. When the addition time is prolonged, there is an advantage that moles of AgX/ml in the emulsion can be increased, while a prolonged addition time has a disadvantage in that the grain size of grains formed becomes larger. It is preferred that the fine grain emulsion have a desired grain size and a large moles of AgX/ml in the emulsion. This is because the total amount of the solutions to be added to form the fine grain emulsion can be reduced and the production efficiency can be increased. Namely, the amount of mol of AgX to be formed can be increased by using the same reaction vessel. The following method can be used in combination with the above-described technique to increase the value of moles of AgX/ml in the fine grain emulsion. Namely, a part or all of the water in the emulsion is removed after the preparation of the fine grain emulsion. The following removal methods can be used.

(1) Vacuum Distillation Method

Figure 2:
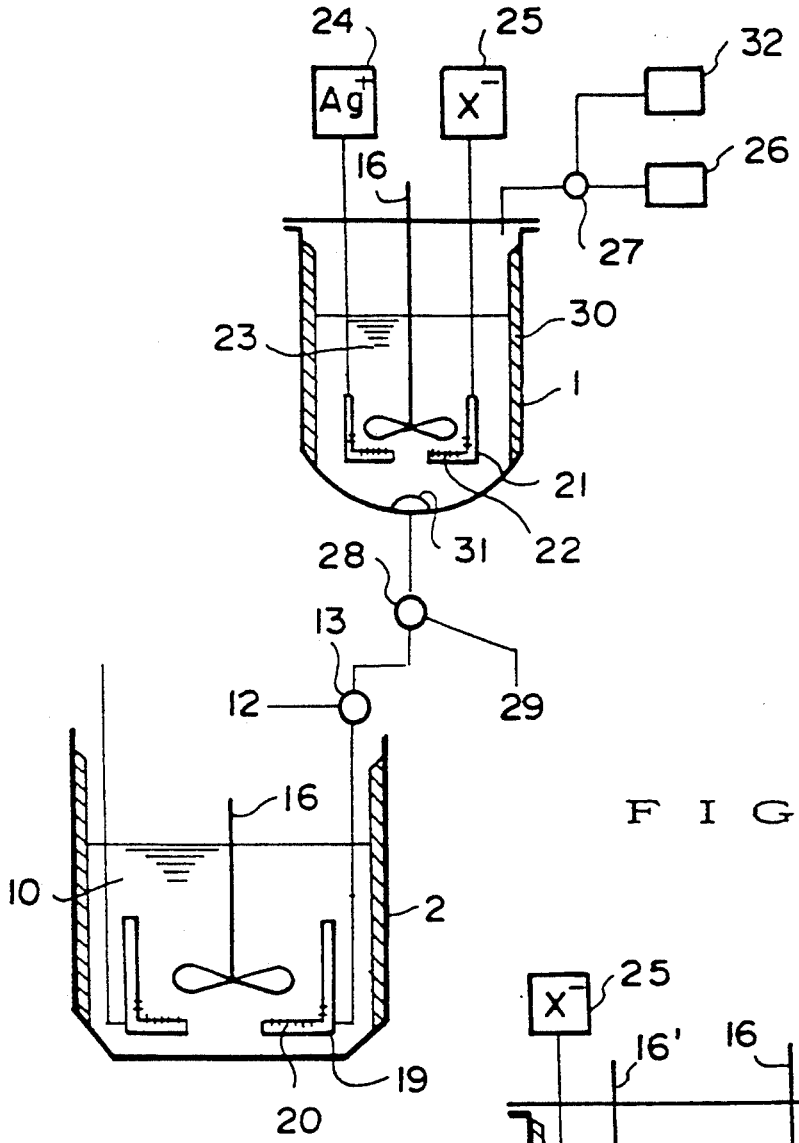
FIG. 2 shows another embodiment of the production unit.

For example, as shown in FIG. 2 the member 32 is provided with a low-temperature trap and a pressure reducing device and the valve 27 is opened to the member 32 to reduce pressure in the mixer, whereby the boiling temperature of the emulsion is lowered and the emulsion begins to boil. When an inert gas (e.g., $N_2$, Ar gas, etc.) or air (preferably dry gas of an inert gas or air) is introduced through the addition port 24 shown in FIG. 2 or a capillary tube separately provided, the evaporation of water can be accelerated. Water vapor evaporated is trapped by a cooling trap. When an oil-rotated pump is used as the pressure reducing device, a cooling trap is provided to prevent the oil from being deteriorated. However, when a water jet pump or a water pump is used, it is not necessary to provide such a cooling trap. In this way, water can be removed by evaporation at a low temperature. Since the temperature is low, the fine grains do not undergo Ostwald ripening. The temperature of the emulsion can be kept constant in a constant temperature bath. Examples of cooling traps which can be used include dry ice, liquid nitrogen freezing means used in (dry ice+ethanol) and refrigerators.

In this case, it is possible to completely dry the fine grain emulsion. The problem with regard to the storage stability of fine grains can be solved by complete drying.

(2) Ultrafiltration Method

The fine grain emulsion is filtered by using an ultrafilter to remove water and to collect fine grains. It is preferred to use a cross flow system wherein the solution is allowed to flow in parallel to the filter surface to prevent the filter from being clogged by filtration. For example, the fine grain emulsion is passed through a cross flow system ultrafilter to concentrate it, and the emulsion is then added to the reactor. Suitable ultrafilters are described in Haruhiko Oya, *Membrane Utilizing Technique Handbook*, (Koshobo 1983).

(3) Water is Removed by a Centrifugal Separation

FIG. 6 of JP-A-1-258862 shows a simple centrifugal separator. The details of the centrifugal separation method and vacuum distillation are described in New Experimental Chemical Lecture, Fundamental Operation [I], Chapter 4, edited by the Chemical Society of Japan (Maruzen 1975) and Experimental Chemical Guidebook, Chapter 3, edited by the Chemical Society of Japan (Maruzen 1984).

The grain size of the fine grains can be selected according to the end-use purpose. When seed crystals are to be grown under high supersaturation degree, it is preferred that the grain size of the fine grains is as small as is possible. This is because the smaller the grain size is the higher is the solubility thereof and the seed crystals can be rapidly grown under high supersaturation degree. The grain size (diameter) in terms of a mean grain size is preferably not larger than 0.2 μm, more preferably not larger than 0.1 μm, most preferably not larger than 0.06 μm. On the other hand, when the seed crystals are to be grown under a low supersaturation degree, it is preferred that the fine grains have a larger grain size. This is because the larger the grain size is the lower is the solubility thereof. To grow seed crystals, however, the fine grains must have higher solubility than that of the seed crystals. The grain size can be chosen from those previously determined (i.e., within 0.2 μm or less) depending on the end-use to purpose. When the seed crystals are to be selectively anisotropic-grown, the above-described growth method under low supersaturation degree is effective. For example, when tabular grains having parallel twinning plane are to be grown selectively only in the direction parallel to principal plane (e.g., grain formation described in Japanese Patent Application No. 1-178545) or when grains having a grain surface composed of two or more crystallographical surfaces are to be selectively grown only on one crystal surface (e.g. grain formation described in JP-A-2-34 corresponding to U.S. patent application Ser. No. 379,838 filed on Jul. 14, 1989 now abandoned), the growth method under low supersaturation degree is effective. The optimum grain size of fine grains can be determined by adding fine grain emulsions having various sizes to grow seed crystals and examining the electron micrographs of the seed crystals grown. Generally, the grain size can be chosen from grains having a projected grain size (diameter) of 0.01 to 0.15 μm, more preferably of 0.04 to 0.1 μm.

Systems for the addition of the aqueous silver salt solution and the aqueous $X^-$ salt solution in the preparation of the fine grain emulsion, which can be used include the gas pressure addition system (a system wherein the added solutions are pressurized by air or $N_2$ and the flow rates of the solutions are controlled through one or more pores according to Hagen-Poiseuille's Law; namely, a system wherein the flow rates are controlled by changing the pressure difference $\Delta P$ between both sides of the pore, the usable sectional area of the hole or both), gear pump, plunger pump, diaphragm pump, etc.

Further, a capacity control type addition device described in Japanese Patent Application No. 2-43791 can be preferably used. These addition systems are described in Japanese Patent Application Nos. 1-258862 and 2-43791, *Chemical Apparatus Handbook*, Chapter 18, edited by Chemical Engineering Society (Maruzen 1989), JP-A-1-199123 and *Chemical Apparatus Encyclopedia*, Chapter 1, edited by Kagaku Kogyo Sha (1976).

It is preferable that the non-twinned grains have substantially no screw dislocation. The terminology "have substantially no screw dislocation" as used herein means preferably 1.0% or less, more preferably 0.1% or less and most preferably 0.01% or less, in the proportion by grain numbers. The non-twinned fine grains produced by the above method have substantially no screw dislocation. Generally, the grains having the screw dislocation have a projected shape of a rectangle or a rhombus. Namely, the above method prevents the formation of screw dislocation.

(II) Addition of Fine Grain Emulsion and Growth of Seed Crystal

FIGS. 1 and 2 show preferred embodiments for using a reaction vessel containing seed crystals and a mixer for forming the fine grains according to the present invention. Namely, after the fine grains are formed, the fine grains are immediately fed to the reaction vessel 2 from the mixer. In this way, a step of storing the fine grain emulsion in a refrigerator and a step of re-dissolving the grains can be eliminated and the problems with regard to the storage stability of the fine grains can be solved.

A plurality of pump addition devices to be alternately used are preferred as the addition device for use in the addition of the fine grain emulsion to the reaction vessel. A typical example of this embodiment is shown in FIG. 1. This embodiment is preferable because while the addition is made by one addition device (e.g., pump A of FIG. 1), the fine grains emulsion to be added at the subsequent step are prepared in the bath type mixer, fed to the other addition device (e.g., B of FIG. 1) and can stand by. In this way, the addition of the fine grain emulsion can be continuously made. If desired, the addition can be intermittently made. Even when fine grains are added at once in the fine grain addition method, there is no possibility that the supersaturation degree of the reaction solution becomes higher than the solubility of the fine grains themselves. Hence, new nuclei are not formed unlike the ion addition method (a method wherein an aqueous solution of silver nitrate and aqueous solution of an alkali halide are added). When the amount of fine grains to be added is increased, the time taken until the all of the fine grains disappear is prolonged.

The time taken until disappearance is preferably not longer than 20 minutes, more preferably not longer than 10 minutes, most preferably 1 to 7 minutes. When the time taken until disappearance is too prolonged, the fine grains undergo Ostwald ripening, the mean grain size of the fine grains becomes larger and the growth rate of the seed crystals is reduced. Namely, a large excess amount of solute ion supply source exists and the deposition step of AgX on the surfaces of the seed crystals becomes the rate-determining step. The supersaturation degree on the surfaces of the seed crystals is nearly equal to the solubility of the fine grains, and the fine grains undergo Ostwald ripening. Generally, as the ratio of the amount by mol of the fine grains/amount of seed crystals is increased, the supersaturation degree on the surfaces of the seed crystals is raised and the growth rate of the seed crystals is increased. However, when the ratio is increased to too great an extent, the probability that the fine grains undergo Ostwald ripening is increased and the growth rate of the seed crystals is lowered. Accordingly, it is preferred that the fine grains and the seed crystals are present in the optimum molar ratio. The optimum molar ratio varies depending on the size of the seed crystal and the conditions of the solutions. Practically, they are mixed in various molar ratios to grow seed crystals, and a molar ratio range is chosen in which the growth rate of the seed crystal is the highest rate. It is most preferred that the seed crystals are grown while maintaining optimum conditions.

When the multiple twinned grains are contained in the fine grain emulsion and the pBr is less than 2 particularly less than 1.4, the new nuclear growth is generated by the growth of multiple twinned grains due to the Ostwald ripening between fine grains. Accordingly, the mol ratio of the fine grains can not be increased and further the growth speed of seed crystals is also decreased. When the multiple twinned grains are not substantially present, the mol ratio of the fine grains can be increased and further the seed crystals can be grown under the condition of high supersaturation. Therefore the effect of the present invention is extremely effected.

The fine grain emulsion can be added at the surface of the solution in the reaction vessel. However, when the fine grain emulsion is introduced into the solution, good stirring efficiency can be obtained and the degree of foaming is low. Hence, the emulsion is generally introduced directly into the solution. Preferred examples of suitable addition devices include those described in JP-B-55-10545, JP-B-58-58288, JP-B-58-58289, JP-A-61-113036, JP-A-62-106451 and JP-Y-60-117834 and Japanese Patent Application No. 3-36582. More preferably, the fine grain emulsion is added through the porous material. The porous material must have pores with a pore size larger than the grain size of the fine grains. In this case, the fine grain emulsion is more preferably added through the adiabatic porous material described in Japanese Patent Application No. 3-36582. It is most preferred that the addition ports of the porous material are uniformly scattered in the solution and the fine grain emulsion added is uniformly mixed in the solution immediately after addition. An example of such an addition system includes the embodiment of FIG. 1 of Japanese Patent Application Nos. 1-76678 and 3-36582.

When the halogen composition of the fine grains to be added is to be changed with the growth of the grains, (1) a method wherein the halogen composition of the fine grains prepared in the batch type mixer (e.g., the member 1 of FIG. 1) is changed from batch to batch, and (2) a method wherein one or more additional fine grain addition systems are provided to prepare fine grain emulsions having different halogen compositions, and the addition rates thereof are changed continuously or stepwise, such as a method wherein the addition rate of each of AgBr, AgCl and AgI fine grain emulsions is changed and/or a method wherein the addition rate of each of AgBr, AgBrCl and AgBrI fine grain emulsions is changed can be used.

When a mixed AgX crystal layer is to be grown, a method wherein a fine AgCl grain emulsion, a fine AgBr grain emulsion and a fine AgI grain emulsion are added is preferable in comparison with the addition of fine grains having the mixed crystal composition, because the former has the advantage that the fine grains can be more rapidly dissolved by an entropy effect and the growth rate can be further increased.

Any of (1) seed crystals previously prepared in a separate reaction vessel, (2) seed crystals prepared in the same reaction vessel (e.g., in member 2 of FIG. 1) and (3) seed crystals prepared in the batch type mixer (e.g., in member 1 of FIG. 1) can be used as the seed crystals in the present invention without particular limitation. However, the seed crystals prepared in the same reaction vessel are preferable, because the seed crystals can be directly fed to the subsequent crystal growth step. Namely, the step of transferring the solution and the step of cleaning the reactor can be eliminated.

In the present invention, the fine grains and seed crystals each is separately prepared.

It is particularly preferred in the present invention that the seed crystals are tabular grains having an average grain size (diameter) of 0.25 mm or more and the pBr at ripening is 2 or less. It is preferred that the tabular grains used are tabular grains in which the tabular grains having an aspect ratio of 1.5 or more occupy generally 50% or more, preferably 70% or more and more preferably 90% or more, based on the total projected area of the grains. Also, it is preferred that the tabular grains are tabular grains in which the parallel double twinned grains having an aspect ratio of 1.5 or more occupy generally 50% or more, preferably 70% or more and more preferably 90% or more based on the total projected area of the grains.

Here, the term "aspect ratio" means diameter/thickness. The term "diameter" means a diameter of a circle having the area equal to a projected area of the grains. Also, the term "thickness" means a distance between main planes of the tabular grains. The pBr value is preferably 2 or less, more preferably 1.7 to 0.4 and most preferably 1.4 to 0.6.

The seed crystals may be subjected to chemical sensitization on the surface of grains. Here, the chemical sensitization used in the present invention include a chalcogenide sensitization using compounds containing sulfur, selenium, tellurium or combination thereof; a gold sensitization using gold compounds such as chloroauric acid, auricthiocyanate and auricthiosulfate; a noble metal sensitization using compounds containing a metal of group VIII in the periodic table such as platinum, iridium and palladium; a reduction sensitization using reducing compounds; and combination thereof. The above sensitizing agents are used for sensitization in an amount of generally $1\times10^{-2}$ mol or less and preferably $1\times10^{-7}$ to $1\times10^{-2}$ mol per mol of AgX (silver halide). The detail is referred in the literature described below.

The formation of seed crystals for the said monodisperse parallel double twinned crystal grains is described in JP-A-2-838, JP-A-2-28638 and JP-A-63-151618 and Japanese Patent Application No. 1-302790. The formation of seed crystals for non-twinned crystal AgX grains is described in JP-A-2-146033. The formation of seed crystals for other known grains is described in the literature described hereinafter. The seed crystals must have such a grain size as to give the relationship of (the solubility of seed crystal < the solubility of fine grain). The seed crystals are very rapidly grown the larger the difference between (the solubility of fine grain) and (the solubility of seed crystal).

In the case of the ion addition method, it is necessary that stirring and mixing are vigorously conducted for uniform mixing and rapid addition of the solutions to the bulking solution. This is because when the concentrations of $Ag^+$ and $X^-$ are locally high, an irreversible heterogeneous reaction takes place, since the solubility product of the AgX is small. Particularly, when large scale production units are used, stirring must be intensively conducted to increase the circulating frequency of the reaction solution. However, vigorous stirring does often damage the large AgX grains particularly grown (e.g., grains undergo pressure fogging, etc.). Since the dissolution rate of the fine grains is slow in the fine grain addition method of the present invention, a heterogeneous reaction scarcely takes place even when the concentration of the fine grains added is locally high. Accordingly, vigorous stirring is not required even when large-scale production units are used. The problem with regard to the damage of grown AgX grains does not occur, and crystal growth can be achieved with good uniform reproducibility. In the formation of the fine grains according to the present invention, stirring is vigorously conducted. However, the fine grains are merely a solute ion supply source and no problem occurs when the fine grains are re-dissolved.

The process of the present invention can be used in combination with the ion addition method described above. For example, during a certain period of grain growth, addition is made by the ion addition method to form a nonuniform mixed AgX crystal layer or to form a layer in which the halogen composition is abruptly changed, whereby a defect in crystal (dislocation defect, etc.) can be formed. Further, pressure resistance, reciprocity characteristics and sensitivity can be improved. For example, when pressure is applied, the dislocation travels as in the billiard state, whereby pressure can be relaxed. Further, when seed crystals are to be grown in the presence of an excess of $X^-$, the $X^-$ salt solution together with the fine grain emulsion can be added. The reason is that when the fine grain emulsion is prepared in the vicinity of the isoionic point of $Ag^+$ and $X^-$, it is necessary that $X^-$ is supplied to the seed crystal emulsion diluted by the addition of the fine grain emulsion. The above-described $X^-$ salt solution addition is effective when the $X^-$ salt solution is previously added to the fine grain emulsion, the solubility of said emulsion is increased, the mean grain size of the fine grains is increased and hence a previous addition is not preferred. It is possible to use the addition of $Ag^+$ and $X^-$ salts solution in an amount of generally less than 70 mol % and preferably less than 30 mol, based on the fine grains.

FIG. 1 shows diagrammatically an apparatus which is a typical example of a preferred embodiment suitable for use in the process for preparing a AgX emulsion according to the present invention. The operation of the apparatus is briefly illustrated below.

An aqueous gelatin solution is placed in a batch type mixer 1. An aqueous silver salt solution and an aqueous $X^-$ salt solution are added thereto to prepare a fine grain emulsion. When the preparation thereof is completed, the addition of the silver salt and the $X^-$ salt is stopped, a valve 5 is opened and a screwed shaft 18 is lifted to thereby allow the fine grain emulsion to be drawn into a cylinder 4. The valve 5 is closed, a valve 6 is opened and the shaft 18 is let down to thereby remove residual air in the cylinder. The valve 6 is then closed, a valve 9 is opened and the shaft 18 is let down to add the fine grain emulsion through addition ports 20 to a reaction solution. The addition rate can be increased stepwise or continuously over an addition period of time at such a rate that no new grains are formed. If desired, the addition can be intermittently made. While the addition is made by means of a plunger pump A, a fine grain emulsion to be subsequently added is prepared in the mixer 1. In the same manner as that described above, the newly prepared fine grain emulsion is introduced into a cylinder B and the removal of air is conducted. When the addition by A is completed, the valve 9 is closed, a valve 9' is opened and a shaft 18' is let down to add the fine grain emulsion in the cylinder B. Subsequently, the above-described operation is repeated. If desired, a cleaning between each step can be conducted, if desired. For example, a valve 13 is opened toward an opening 12, the shaft 18 is lifted to thereby allow water to be drawn into the cylinder A from the opening 12. The valve 6 is then opened to discharge water through the opening 12. The shaft 18 is let down to discharge water through the openings 12 and/or 7, whereby cleaning is accomplished. Cleaning can also be made by drawing water through an opening 8 and discharging water through the openings 8 and/or 7.

Numeral 17 represents a system control device which is a control device which controls sequentially and systematically the whole of the device such as on—off of each valve, the initiation and ending of stirring, the metering of the solution, the initiation and ending of C.D.J. (controlled double jet) control, etc. according to the predetermined order. Any of the conventional control devices can be used. The details of the control devices are described in *Sequence Automatic Control Handbook*, prepared under the supervision of Mr. Zenzaburo Sawai (Ohm sha 1971).

Numeral 19 represents a mixing box which is referred in JP-A-51-72994.

FIG. 2 shows another embodiment of an apparatus according to the present invention. An aqueous gelatin solution is placed in the batch type mixer 1, and an aqueous silver salt solution and an aqueous $X^-$ salt solution are added thereto to prepare a fine grain emulsion. When the preparation of the fine grain emulsion is completed, the addition of the silver salt and the $X^-$ salt are stopped and valves 31, 27 are opened. While gas pressure is controlled by a gas pressure control device 26, gas pressure is applied to the mixer 1 to thereby add the fine grain emulsion to a reaction vessel 2. The flow rate of the addition is controlled by appropriately choosing the applied gas pressure and the diameter of orifice 28. It is preferred that two or more batch type mixers be used.

Numerals 20, 22 represent each a porous material. The porous material 20 has 200 pores with a pore size (i.e., diameter) of 0.3 mm, and the porous material 22 has $10^3$ pores having a pore size (diameter) of 0.15 mm. The pores are uniformly distributed on the inner surface of the mixing box.

(III) Other Conditions

The process of the present invention is preferably applied to the addition system of a series batch system continuous production unit described in Japanese Patent Application No. 1-258862.

When the present invention is used for the preparation of negative AgX emulsions, it is preferred that positive hole capturing reduction sensitized silver nuclei is incorporated in the AgX grains. The conditions thereof generally vary depending on temperature, pH and pAg during the course of the crystal growth of the AgX emulsion grains and growth time. When the temperature and pH are raised, the pAg is lowered and the growth time is prolonged, the formation of silver nuclei per unit volume is increased. Further, the conditions vary depending on the types of reducing agents to be added and the amounts thereof. However, when the amount of reduced silver formed is increased to too great an extent, fogging is increased and hence such an increase in reduced silver is not preferred. The conditions during grain growth are changed and chosen so that the highest photographic sensitivity can be obtained ultimately.

The pH range which is generally used is from 1.8 to 11 and preferably from 2 to 10, the $pX^-$ (i.e., $-\log$ [$X^-$ concentration (mol/liter)]) range is generally from 6 to 0.4, and preferably from 4 to 0.6, and the temperature is generally from 40° to 90° C. and preferably from 50° to 85° C.

The temperature control of the reaction vessel, C.D.J. (controlled double jet) control, the materials of the reaction vessel and pump parts in contact with the solutions, stirring and mixing methods, the use of baffle plate in combination are described in Japanese Patent Application Nos. 1-207513, 1-144724, 1-258862 and 2-43791.

Silver halide emulsion grains which can be prepared by the method for preparing a silver halide emulsion according to the present invention include all AgX grains which can be formed by conventional methods, such as twinned crystal grains having twinning plane, tabular grains having a parallel twinning plane, regular crystal grains having no twinning plane (e.g., cube, octahedron, tetradecahedron, etc.), rhombic dodecahedral grains, triaxisoctahedral grains, icositetrahedral grains, tetraxishexahedral grains, hexaoctahedral grains. With regard to halogen composition, any of halogen compositions such as AgCl, AgBr, AgI, mixed crystals thereof, etc can be used without particular limitation. With regard to grain size, the present invention can be used for the preparation of silver halide grains having a grain size (i.e., diameter) of not smaller than 0.25 μm, preferably 0.4 to 5 μm. These matters are described in the literature described hereinafter.

Dispersion media conventionally used for silver halide emulsions can be used in the preparation of the silver halide emulsion of the present invention. Gelatin, various other hydrophilic colloid and synthetic colloid can be used. Generally, gelatin is preferable. Examples of usable gelatin include alkali processed gelatin, acid-processed gelatin, gelatin derivatives such as phthalated gelatin and low-molecular weight gelatin (having a molecular weight of about 2,000 to about 100,000, e.g., enzymatic hydrolyzates of gelatin, gelatin hydrolyzates obtained by hydrolysis of gelatin with acids or alkali, heat-decomposed gelatin). Generally the alkali processed gelatin is preferably used. These gelatin compounds may be used as a mixture of two or more of them, if desired.

In addition thereto there can be used compounds obtained by bonding gelatin to an antiseptic agent (e.g., phenol, phenol derivative, etc.) and/or antifogging agent through a bivalent bonding group (the details thereof are described in Japanese Patent Application No. 1-144724, graft polymers of gelatin with other high-molecular weight materials, thioether polymers, protein such as albumin and casein, cellulose derivatives such as hydroxyethyl cellulose, carboxymethyl cellulose and cellulose sulfate, sodium alginate, saccharose derivatives such as starch derivatives, and various synthetic high-molecular weight materials such as homopolymers, for example, polyvinyl alcohol, polyvinyl alcohol partial acetal, poly-N-vinylpyrrolidone, polyacrylic acid, polymethacrylic acid, polyacrylamide, polyvinylimidazole and polyvinylpyrazole and copolymers thereof or mixtures thereof.

The details thereof are described in the literature described hereinafter.

Antiseptic agents are described in *Antifungal and Mildewproofing Handbook*, Chapter 3, edited by Nippon Antifungal Mildewproofing Society and *Chemistry of Germicidal Antifungal Agents*, written by Hiroshi Horiguchi (Gihodo 1986). The anti-fogging agents are described in the literature described hereinafter.

The details of these compounds are described in the literature described hereinafter.

Solvents for silver halide can be used during the course of the crystal growth to accelerate crystal growth, or can be used after the formation of the grains and/or during chemical sensitization to conduct effectively chemical sensitization.

Examples of suitable solvents for silver halide which are often used include thiocyanates, ammonia, thioethers and thioureas. The details of these compounds are described in the literature described hereinafter.

Various additives can be used during the course of steps ranging from the formation of grains to coating in the preparation of the silver halide emulsion of the present invention without particular limitation. Examples of suitable additives which can be used include solvents for silver halide (sometimes called ripening accelerator), doping agents with which silver halide grains are doped [e.g., Group VIII noble metal compounds and other metallic compounds (e.g., gold, iron, lead, cadmium, etc.), chalcogen compounds, SCN compounds, etc.], dispersion mediums, anti-fogging agents, stabilizers, sensitizing dyes (blue, green, red, infrared, panchromatic, ortho), supersensitizing agents, chemical sensitizing agents (e.g., chemical sensitizing agents such as sulfur, selenium, tellurium, gold and Group VIII noble metal compounds and phosphorus compounds alone or in combination; most preferred are chemical sensitizing agents composed of a combination of gold, sulfur and selenium compounds and reduction sensitizing agents such as stannous chloride, thiourea dioxide, polyamines and amineborane compounds, etc.), fogging agents (organic fogging agents such as hydrazine compounds and inorganic compounds), surfactants (anti-foaming agents, etc.), emulsion settling agents, soluble silver salts (Ag SCN, silver phosphate, silver acetate, etc.), latent image stabilizers, pressure desensitization inhibitors, thickeners, hardening agents, developing agents (hydroquinone compounds, etc.) and development modifiers. Specific compounds and the use thereof are described in the following literature.

Further, the rinsing step for emulsions, chemical sensitization step, coating step, exposure step, development step, the layer structures of AgX emulsion-coated materials, the storage of the coated materials, etc. are described in the following literature, and conventional techniques and all of combinations with known compounds described in the following literature can be used in the present invention.

The details of the above-described compounds, additives, etc. are described in *Research Disclosure*, Vol. 176 (No. 17643, December 1978), ibid., Vol. 184 (No. 18431, August 1979), ibid., Vol. 216 (No. 21728, May, 1982), ibid., Vol. 307 (No. 307105, November, 1989) monthly report of Nikkakyo, pp 18–27 (December, 1984), Journal of the Japanese Photography Society, Vol. 49, pp. 7–12 (1986), ibid., Vol. 52, pp 144–166 (1989), JP-A-58-113926 to 113928, JP-A-59-90842, JP-A-59-142539, JP-A-62-253159, JP-A-62-99751, JP-A-63-151618, JP-A-62-251, JP-A-62-115035, JP-A-63-305343, JP-A-62-269958, JP-A-61-112142, JP-B-59-501776, Japanese Patent Application Nos. 62-263319, 62-208241 and 1-131541, JP-A-2-146033, JP-A-2-838, JP-A-62-266538, JP-A-63-220238, JP-A-1-297649, U.S. Pat. Nos. 4,977,074, 4,705,744 and 4,707,436, T. H. James, *The Theory of the Photographic Process* (Fourth Edition) (Macmillan, New York 1977), V. L. Zelikman et al., *Making and Coating Photographic Emulsion* (The Focal Press 1964), P. Glafkides, *Photographic Chemistry and Physics* (Fifth Edition de l' Usine Novelle, Paris, 1987), ibid., (second Edition Paul Montel, Paris, 1957), K. H, Hoilister, *Journal of Image Sci.*, 31, pp 148–156 (1978), J. E. Maskasky, *Journal of Imaging Science*, 30, pp 247–254 (1986), H. Frieser et. al., *Fundamental of Photographic Stage of Silver Halide*, Academische Verlagsgesellschaft, Frankfurt Am Main. (1968) and Japanese Patent Application Nos. 1-76678, 1-258862 and 1-144724.

The present invention is now illustrated in greater detail by reference to the following examples which, however, are not to be construed as limiting the invention in any way. Unless otherwise indicated herein, all parts, percents, ratios and the like are by weight.

EXAMPLE 1

Figure 3:
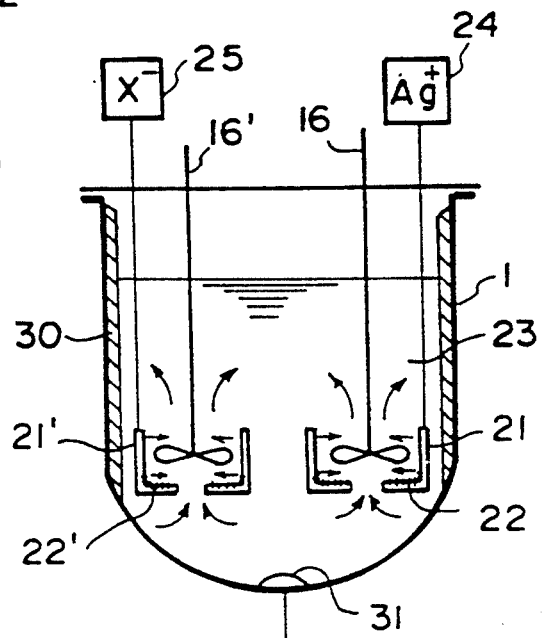
FIG. 3 shows an even further embodiment of the batch type mixer.

A production unit comprising an embodiment of FIG. 1 provided with two sets (No. 1 and No. 2) of the mixer of FIG. 3 as the mixing devices for the formation of fine grains was used and the following procedures were conducted.

Preparation of Seed Crystal

An aqueous gelatin solution [$H_2O$: 12 l, low-molecular weight gelatin having an average molecular weight of 20,000 (2LGel) 84 g, KBr 54 g, pH 6.0] was placed in the reaction vessel 2 of FIG. 1 and the temperature was kept at 30° C. While stirring the aqueous gelatin solution, an aqueous solution of $AgNO_3$ (containing 20 g of $AgNO_3$, 0.7 g of 2LGel and 0.16 ml of 1N $HNO_3$ solution per 100 ml) and an aqueous solution of KBr (containing 14.9 g of KBr and 0.7 g of 2LGel per 100 ml) were simultaneously added thereto at a rate of 480 ml/min, whereby 528 ml of each solution was added. After completion of the addition, the mixture was stirred for one minute. Subsequently, an aqueous gelatin solution [1.62 l of $H_2O$, 380 g of deionized alkali-processed gelatin, pH 5.5] was added thereto. After the mixture was stirred for 2 minutes, the temperature thereof was elevated to 75° C. over a period of 10 minutes. After the temperature was elevated, the mixture was ripened for 16 minutes, $AgNO_3$ (180 g/l) was added thereto at a rate of 70 ml/min and the silver potential (vs. a saturated calomel electrode at room temperature, hereinafter the same) of the solution was adjusted to −10 mV. Subsequently, 95 ml of $NH_4NO_3$ (50 wt % solution) and 95 ml of $NH_3$ (25 wt % solution) were added thereto. After the mixture was ripened for 18 minutes, 3N-$HNO_3$ solution was added thereto and the pH was adjusted to 5.5. An aqueous solution of KBr (100 g/l) was then added thereto, and the silver potential of the solution was adjusted to −20 mV. An aqueous solution of $AgNO_3$ (180 g/l) and an aqueous solution of KBr (131 g/l) were added at a silver potential of −20 mV by means of controlled double jet (C.D.J.) process. The addition rate of Ag $NO_3$ was 100 ml/min and the addition was made over a period of 8 minutes. At this point, sampling was made. Characteristics determined from the transmission type electron micrograph image (TEM image) of the replica of the emulsion grains were as follows. The mean grain size was 0.7 μm, the average thickness was 0.13 μm, the coefficient of variation (C.V.) in grain size distribution was 18%, and the proportion of the projected areas of tabular grains in the emulsion grains was 99.9%. A KBr solution (300 g/l) was added to the emulsion to adjust the pBr to 1.0.

Preparation of Fine Grain Emulsion

An aqueous gelatin solution (containing 3.6 l of $H_2O$, 72 g of 2 LGel and 0.6 g of KBr) was placed in mixer 1 of FIG. 3, and the temperature thereof was kept at 25° C. While stirring, an aqueous solution of $AgNO_3$ [containing 32 g of $AgNO_3$, 1 g of 2LGel and 0.24 ml of 1N $HNO_3$ per 100 ml] and an aqueous $X^-$ salt solution [containing 22.45 g of KBr and 1 g of 2LGel per 100 ml] were added at a rate of 300 ml/min for 3 minutes. The rotating direction of both agitating blades was the same. Further, stirring was conducted for 2 minutes and then stopped. When the stirring was stopped, the precipitation of AgX grains did not occur, because gelatin having an average molecular weight of 20,000 was used and the AgX grains were fine grains. The preparation of the fine grain emulsion and the preparation of the seed crystals were completed at the same time. A sampling of the resulting fine grain emulsion was made. A methanol solution of the following dye I was added thereto to allow the dye to be adsorbed by the emulsion. The emulsion was diluted and a thin layer thereof was placed on a mesh having a collodion membrane thereon and dried. Carbon was deposited thereon, and the resulting mesh was immersed in a methanol solution to remove the collodion membrane. The mesh was immersed in cool water to remove $KNO_3$ salt. After drying, a photograph of transmission type electron micrograph image was taken. It was found that the grains had a mean grain size (i.e., diameter) of 0.025 μm from the micrograph image.

Dye I:

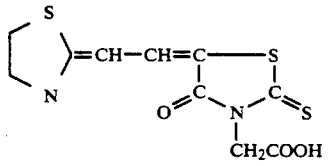

After the fine grain emulsion was prepared, this emulsion was drawn into the cylinder A of the addition system of FIG. 1. After 3 minutes, the addition of the fine grains emulsion was started and continued in the addition speed of 300 ml/minute for 10 minutes and after 2 minutes, 1 ml of the emulsion was collected and then mixed with 4 ml of a 0.08 wt % metanol solution of Dye I. The TEM image of the obtained grains was observed. The new nuclear growth was not observed.

Next, the same seed crystals and fine grain emulsion were prepared. The experimentation was carried out with various addition speed. As a result, the new nuclear growth was observed when the addition speed exceeded 400 ml/minute corresponding to the Ag addition speed of 0.125 mol/minute.

Further, the same seed crystals and fine grain emulsion were prepared. The emulsion was added at the initial addition speed of the fine grain emulsion of 365 ml/minute, at the linear flow rate acceleration rate of 7.7 ml/minute, for 13 minutes and further subjected to ripening for 2 minutes. An aqueous solution of KBr was added to the seed crystal emulsion during the course of crystal growth to keep the pBr value of the seed crystal emulsion at 1.0. Subsequently, a precipitant was added thereto, the temperature was lowered to 30° C. and the pH was lowered to 4.0 with an acid (i.e., nitric acid). The emulsion was washed with water by a precipitation rinsing method. The temperature was elevated to 40° C. An aqueous gelatin solution was added to the emulsion, the pH was adjusted to 6.2 and the pBr was adjusted to 2.8. The resulting emulsion was re-dispersed. The TEM image of the replica of the resulting emulsion was observed, and it was found that the following results were obtained.

| | |
|---|---|
| Average Thickness of Grain | 0.13 μm |
| Mean Grain Size | 1.2 μm |
| Grain Size Distribution (C.V.) | 17% |
| Proportion of Projected Areas of Tabular Grains | 99.9% |
| Proportion of Projected Area of New Grains Mixed | 0% |

The temperature of the emulsion was elevated to 55° C., and a dye II in an amount of 70% of the saturated adsorption amount was added thereto. After 10 minutes, sodium thiosulfate and (chloroauric acid+sodium thiocyanate) were added thereto, and chemical sensitization was conducted to the maximum. The temperature of the emulsion was lowered to 40° C. and an antifogging agent [TAI (4-hydroxy-6-methyl-1,3,3a,7-tetraazaindene)] in an amount of $7\times10^{-3}$ mol/mol of AgX was added thereto. After 10 minutes, a coating aid (sodium dodecylbenzenesulfonate) and a thickener [sodium salt of poly(4-sulfostyrene)] were added thereto. The resulting emulsion together with a gelatin protective layer was coated on a transparent cellulose triacetate support in such an amount as to give a coating weight of 1.5 g/m² in terms of silver, and the coated material was dried.

Dye II:

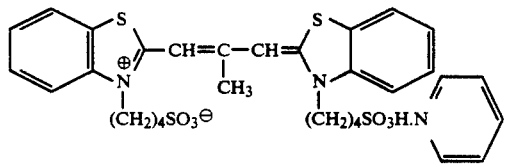

COMPARATIVE EXAMPLE 1

A production unit comprising an embodiment of FIG. 1 provided with two sets of the mixers (one addition port for each of the solutions to be added) was used and the following procedures was conducted.

A fine grain emulsion was prepared in the same manner as in Example 1 except that the following modification was made.

An aqueous gelatin solution [containing 3.6 l of $H_2O$, 24 g of 2LGel and 7.2 g of KBr] was placed in the mixer and the temperature thereof was kept at 25° C. While stirring, an aqueous solution of $AgNO_3$ (320 g/l) and an aqueous $X^-$ salt solution (KBr 228 g/l) were added thereto at a rate of 300 ml/min for 3 minutes. A 2LGel solution (60 g of 2LGel, 300 ml of $H_2O$) was added thereto and stirring was conducted for 2 minutes and then stopped. Next, the fine grain emulsion was added in the same manner as in Example 1 with various addition speed for 10 minutes. As a result, the new nuclear growth was observed when the addition speed exceeded 130 ml/minute. Accordingly, the critical addition speed was about ⅓ times that of Example 1. This critical addition speed corresponds to an Ag addition speed of about 0.04 mol/minute.

COMPARATIVE EXAMPLE 2

Seed crystals were prepared in the same manner as in Example 1, and the fine grain emulsion was prepared in the following manner.

The same mixer as that described in U.S. Pat. No. 4,879,208 was used, and the aqueous gelatin solution, the aqueous $AgNO_3$ solution and the aqueous $X^-$ salt solution used in the formation of the fine grain emulsion of Example 1 were used. These solutions were continuously fed to the mixer over a period of 16 minutes by means of the triple jet process, mixed and fed to the seed crystal emulsion. Further, the aqueous gelatin solution, the aqueous $AgNO_3$ solution and the aqueous $X^-$ salt solution (each having the same composition as that of Example 1) were used. The equal speed addition was carried out with the various addition speed for 10 minutes. The new nuclear growth was generated when the addition speed of the aqueous $AgNO_3$ solution and the aqueous $X^-$ solution exceeded 14 ml/minute corresponding to an Ag addition speed of 0.026 mol/minute.

Accordingly the critical addition speed was about 1/4.8 of that of Example 1.

Also, 100 ml of the fine grain emulsion of Example 1, 100 ml of the fine grain emulsion of Comparative Example 1 and 100 ml of the fine grain emulsion of Comparative Example 2 were collected and then the aqueous $AgNO_3$ solution and the aqueous KBr solution were added at 30° C. to each the collected emulsions. And the proportion (by number) of multiple twinned grains and single twinned grains each was measured in the method described above. The results are as follows.

| Proportion (by number) of multiple twinned grains: |
|---|
| Example 1: 0% |
| Comparative Example 1: 2% |
| Comparative Example 2: 3% |
| Proportion (by number) of single twinned grains: |
| Example 1: 0.1% or less |
| Comparative Example 1: 18% |
| Comparative Example 2: 23% |

Thus, the effect of the present invention was confirmed.

Further, since the fine grain emulsion of the present invention is fed to the seed crystal emulsion directly from the mixer where the fine grain emulsion is prepared, no problems with respect to storage and stability during storage occur.

EXAMPLE 2

An aqueous gelatin solution ($H_2O$: 12 l gelatin ($\overline{M}$=20,000): 84 g, KBr: 54 g, pH: 6.5) was added to a reaction vessel and the temperature thereof was regulated to 30° C. While stirring, an aqueous solution of $AgNO_3$ (containing 200 g of $AgNO_3$, 8.4 g of gelatin($\overline{M}$=20,000) and 4 ml of $HNO_3$ (0.5N) per 1,000 ml) and an aqueous solution of KBr (containing 149 g of KBr, 8.4 g of gelatin ($\overline{M}$=20,000) and 4 ml of $HNO_3$ (0.5N) per 1,000 ml) were added thereto at a rate of 480 ml/min, whereby 528 ml of each solution was added. After one minute, an aqueous gelatin solution (1,620 ml of $H_2O$, 380 g of deionized alkali-treated gelatin, pH: 6.5) was added thereto. The mixture was stirred for 2 minutes, and the temperature thereof was elevated to 75° C. After the first ripening was carried out for 12 minutes, an aqueous solution of $AgNO_3$ (containing 180 g of $AgNO_3$ per 1,000 ml) was added thereto at a rate of 70 ml/min, and the silver potential of the solution was adjusted to +15 mV. Subsequently, 95 ml of an aqueous solution of $NH_4NO_3$ (50 wt %) was added thereto, and the mixture was ripened for 18 minutes. An aqueous solution of $HNO_3$ (3N) and an aqueous solution of KBr (10 wt %) were then added thereto, and the pH was adjusted to 6.7 and the silver potential was adjusted to −20 mV. An aqueous solution of $AgNO_3$ (containing 180 g of $AgNO_3$ per 1,000 ml) and an aqueous solution of KBr (containing 131 of KBr per 1,000 ml) were added thereto at a silver potential of −20 mV by means of C.D.J. process. The addition rate was 100 ml/min and the addition was made over a period of 8 minutes. At this point, sampling was made, and the TEM image of the sampled emulsion grains was evaluated. It was found that the mean grain size (diameter) of grains based on the projected areas of the grains was 0.61 μm, the average thickness of the grains was 0.185 μm (namely, the average volume being 0.054 $\mu m^2$), the proportion of the number of hexagonal tabular grains was 99.9%, and a coefficient of variation in grain size distribution was 12%.

Up to this point, the formation of seed crystals was exemplified. In this way, three sets of seed crystal emulsions were prepared. Each of these emulsions was divided into some portions (each portion being 1,100 ml).

550 ml of a fine grain *2a* emulsion described hereinafter was added thereto, and a KBr solution was added at 75° C. to adjust the pBr values to 1.8, 1.5, 1.3, 1.0 and 0.6, respectively. The emulsions were then ripened, and 1 ml of each emulsion was sampled each time with the passage of the ripening time. The electron micrograph of the sampled emulsion was observed and a time taken until fine grains disappeared was determined therefrom. The value of (moles of fine grains added/the time taken until fine grains disappeared) was determined. The curve b in FIG. 4 shows the value.

In the same manner as described in Example 1, an experiment was made by using a fine grain *2b* emulsion described hereinbelow, and the value was determined in the same manner as described in Example 1. The curve c in FIG. 4 shows the value.

An aqueous Ag-2 solution (Ag $NO_3$: 18 g/100 ml) and an aqueous X-2 solution (containing X at concentration at which pBr being kept constant when the aqueous X-2 solution being added in an amount equal to that of A-2) were used. The given amounts of these solutions were simultaneously added while silver potential was kept constant. A critical addition rate at which new grain began to form was determined. The curve d in FIG. 4 shows the value.

The critical growth rate at a pBr of not higher than about 1.3, particularly the optical growth rate at a pBr of not higher than 1.0 was such that curve b>curve c>curve d.

The monodispersibility of grains obtained at this time was such that curve b>curve c>curve d.

Accordingly, the critical addition rate (=critical growth rate) is higher the lower the proportion of multiple twinned grains contained in the fine grains added, and there can be obtained tabular emulsion grains having good monodispersibility. Thus, the effect of the present invention can be confirmed.

Preparation of Fine Grain *2a* Emulsion

An aqueous gelatin solution (containing 3600 ml of $H_2O$, 72 g of 2LGel and 0.9 of KBr) was placed in the mixer of FIG. 2 and the temperature thereof was kept at 30° C. While stirring, an aqueous solution of $AgNO_3$ (containing 30 g of $AgNO_3$, 1 g of 2LGel and 0.24 ml of 1N-$HNO_3$ solution per 100 ml) and an aqueous solution of KBr (containing 21.05 g of KBr, 1 g of 2LGel and 0.24 ml of 1N-$HNO_3$ solution per 100 ml) were added thereto at a rate of 200 ml/min over a period of 4.5 minutes. Further, stirring was continued for 2 minutes, and the temperature was brought to 20° C. The resulting grains had a mean grain size (diameter) of 0.06 μm, and the proportion of multiple twinned grains contained therein was not more than 0.01%. (Identification method is described in JP-A-2-146033 (corresponding to U.S. patent application Ser. No. 334,056 filed on Apr. 6, 1989, now abandoned)).

Preparation of Fine Grain *2b* Emulsion

An apparatus described in JP-A-51-72994 (corresponding to GB 1515139 was used. An aqueous solution of $AgNO_3$ (containing 3600 ml of $H_2O$ and 6.48 g of KBr) was placed in the vessel, and the temperature thereof was kept at 30° C. While stirring, an aqueous solution of $AgNO_3$ (containing 30 g of $AgNO_3$ per 100 ml) and an aqueous solution of KBr (containing 21.36 g of KBr per 100 ml) were added thereto at a rate of 300 ml/min over a period of 3 minutes. Further, stirring was continued for 2 minutes, and the temperature was lowered to 20° C. The resulting grains had mean grain size (diameter) of 0.06 μm and the proportion of multiple twin grains contained therein was about 1.5%. Also, the variation coefficient of grain size distribution of each the fine grain emulsions was 36% in Example 1 and 32% at *2a* of Example 2, respectively.

The process for preparing an AgX emulsion according to the present invention has the following advantages.

1. Since the fine grains contain substantially no multiple twinned crystal grains, the fine grains can be easily re-dissolved and hence new nuclei are scarcely formed. This effect is remarkable when seed crystals having parallel twinning plane are grown under high $X^-$ concentration conditions in particular at a pBr of preferably 1.4 or less, more preferably from 1.3 to 0.4 and most preferably from 1.0 to 0.5. For example, when seed crystals are grown under high $Br^-$ concentration conditions in the ion addition method, the probability that fine grain nuclei formed in the vicinity of the addition port of the aqueous silver salt solution have parallel twinning plane is increased. The fine grain nuclei are rapidly grown to thereby form thin large plate-form new nuclei. More specifically, the characteristics of the fine grain nuclei formed are changed with a change in the pBr value of the seed crystal emulsion. In the present invention, the fine grain nuclei are fed after stable fine grain nuclei containing substantially no multiple twinning crystals are formed in a separate mixer and hence there is the advantage that factors during the course of the formation of grains can be independently controlled.

2. The fine grain emulsion is prepared and immediately fed to the reaction vessel without rinsing so that the step of storing the fine grain emulsion can be eliminated, the problem with regard to the change of grain size during storage does not occur and the step of re-dissolving the emulsion can be removed.

3. When the formation of the fine grains is carried out in the batch type mixers described in (1) to (3) of item (I) described hereinbefore, the following advantages in comparison with the mixer described in JP-A-1-183417 (which is incorporated by reference) are achieved.

(a) The diluting effect of the bulking solution can be more effectively utilized and the formation of multiple twinned crystal grains can be effectively inhibited. For example, when the batch type mixer of FIG. 3 is used, a much better effect can be obtained.

(b) The grain size of the fine grain emulsion can be arbitrarily chosen depending on the end-use purpose. Accordingly, when the seed crystals are grown, the supersaturation degree can be arbitrarily chosen. The seed crystals can be anisotropically grown.

(c) Since a uniform average residence time of the fine grains can be achieved, the grain size distribution of the fine grains can be made much more uniformed. Accordingly, supersaturation degree in the reaction solution can be controlled with high accuracy.

(d) The value of the amount of silver/ml in the fine grain emulsion can be increased. Accordingly, the moles of AgX which can be prepared in a given reactor can be increased and production efficiency can be raised. When the addition time of the aqueous silver salt and the aqueous $X^-$ salt solution is prolonged, the value of the amount of silver/ml can be increased, but grain size is also increased. An increase in the grain size can be inhibited by lowering the temperature to inhibit the growth of nuclei initially formed, or making an addition to form new grains, or using a combination thereof.

4. When the fine grain emulsion is added by using a plurality of pump addition devices which are alternately used, the fine grain emulsion can be continuously added without any waiting period between steps.

5. Since it is not necessary that the reaction solution is vigorously stirred, the grown seed crystals are physically scarcely damaged by stirring, and AgX emulsion grains which are scarcely fogged by pressure can be produced.

6. Since a localized high $Ag^+$ concentration region does not exist, AgX emulsion grains can be prepared wherein reduction sensitization level in the interiors of grains or among grains can be much better controlled. Accordingly, photographic materials which are highly sensitive and give image of high quality can be obtained.

7. When mixed AgX crystal grains are formed, mixed crystals having a uniform composition can be formed. Further, a uniform composition part and a non-uniform composition part in the interior of grain can be formed according to the predetermined plan.

While the invention has been described in detail and with reference to specific embodiments thereof, it will be apparent to one skilled in the art that various changes and modifications can be made therein without departing from the spirit and scope thereof.

What is claimed is:

1. A method for preparing silver halide emulsion grains by a crystal growth method comprising feeding fine silver halide grains to a reaction vessel containing seed crystals of silver halide emulsion and dissolving the fine grains in said reaction vessel by Ostwald ripening to grow said seed crystals, wherein the fine grains are non-twinned crystal fine grains having substantially no twinning plane.

2. A method for preparing silver halide emulsion grains as in claim 1, wherein said method comprises forming said fine grains by providing a batch type mixer outside said reaction vessel, introducing an aqueous solution of a dispersion medium into the mixer and adding an aqueous solution of a silver salt and an aqueous solution of a halide salt thereto while stirring, and immediately feeding said fine grains after formation to the reaction vessel from the mixer.

3. A method for preparing silver halide grains as in claim 2, wherein said seed crystals are tabular emulsion grains having an average grain size of 0.25 μm or more in which the tabular grains having an aspect ratio of 1.5 or more occupy 50% or more based on the total projected area of the grains, and has a pBr of 2 or less at ripening.

4. A method for preparing silver halide grains as in claim 2, wherein said seed crystals are tabular emulsion grains having an average grain size or 0.25 μm or more, and 50% or more of the total projected area of the seed crystals is occupied by parallel double twinned tabular grains having an aspect ratio of 1.5 or more.

5. A method for preparing silver halide emulsion grains as in claim 1, wherein said method comprises forming said fine grains by adding at least one of said aqueous solution of a silver salt and said aqueous solution of a halide salt to a batch type mixer through a porous material which is present in said aqueous solution of said dispersion medium.

6. A method for preparing silver halide emulsion grains as in claim 1, wherein said method comprises forming said fine grains by separately diluting said aqueous solution of a silver salt and said aqueous solution of a halide salt with a bulking solution and then mixing them.

7. A method for preparing silver halide emulsion grains as in claim 1, wherein said method comprises forming said fine grains in the presence of a low-molecular weight gelatin dispersion medium at a temperature of 5° to 40° C.

8. A method for preparing silver halide emulsion grains as in claim 1, wherein said method comprises forming said fine grains by adding said aqueous solution of a silver salt and said aqueous solution of a halide salt by means of an accelerating addition method which involves the formation of new nuclei.

9. A method for preparing silver halide emulsion grains as in claim 1, wherein said method comprises adding said fine grains to the reaction vessel by using a plurality of pumps alternately used.

10. A method for preparing silver halide emulsion grains as in claim 1, wherein said fine grains are multiple non-twinned crystal fine grains having substantially no multiple twinning plane so that the proportion by number of grains having a multiple twinning plane is not more than 1%.

11. A method for preparing silver halide grains as in claim 1, wherein said seed crystals are tabular emulsion grains having an average grain size of 0.25 μm or more in which the tabular grains having an aspect ratio of 1.5 or more occupy 50% or more based on the total projected area of the grains, and has a pBr of 2 or less at ripening.

12. A method for preparing silver halide grains as in claim 1, wherein said seed crystals are tabular emulsion grains having an average grain size of 0.25 μm or more, and 50% or more of the total projected area of the seed crystals is occupied by parallel double twinned tabular grains having an aspect ratio of 1.5 of more.

13. A method for preparing silver halide grains as in claim 1, wherein the proportion by number of the fine grains having a multiple twinning plane is not more than 0.3%.

14. A method for preparing silver halide grains as in claim 1, wherein the proportion by number of the fine grains having a multiple twinning plane is not more than 0.1%.

15. A method for preparing silver halide grains as in claim 1, wherein the proportion by number of the fine grains having a multiple twinning plane is not more than 0.01%.

16. A method for preparing silver halide grains as in claim 1, wherein none of the fine grains contain a multiple twinning plane.

17. A method for preparing silver halide grains as in claim 1, wherein the proportion by number of the fine grains having a single twinning plane is 5% or less.

18. A method for preparing silver halide grains as in claim 1, wherein the proportion by number of the fine grains having a single twinning plane is 1% or less.

19. A method for preparing silver halide grains as in claim 1, wherein the proportion by number of the fine grains having a single twinning plane is 0.1% or less.

* * * * *